US009220330B2

(12) United States Patent
Kelson

(10) Patent No.: US 9,220,330 B2
(45) Date of Patent: Dec. 29, 2015

(54) CARRYING DEVICE FOR PORTABLE OBJECTS

(76) Inventor: Rosa O. Kelson, Dallas, TX (US)

( * ) Notice: Subject to any disclaimer, the term of this patent is extended or adjusted under 35 U.S.C. 154(b) by 889 days.

(21) Appl. No.: 10/057,604

(22) Filed: Jan. 24, 2002

(65) Prior Publication Data

US 2003/0136808 A1 Jul. 24, 2003

(51) Int. Cl.

| | |
|---|---|
| ***A45C 7/00*** | (2006.01) |
| ***A45C 13/38*** | (2006.01) |
| *A45F 3/14* | (2006.01) |
| *A45F 5/10* | (2006.01) |

(52) U.S. Cl.

CPC ..... *A45C 13/38* (2013.01); *A45C 7/0077* (2013.01); *A45F 2003/142* (2013.01); *A45F 2005/1013* (2013.01)

(58) Field of Classification Search

CPC ..... A45C 13/38; A45C 13/30; A45F 3/14; A45F 2003/142

USPC ..... 224/578, 579, 602, 607, 250; 294/157, 294/167, 149–153

See application file for complete search history.

(56) References Cited

U.S. PATENT DOCUMENTS

| | | | | | |
|---|---|---|---|---|---|
| 613,733 | A | * | 11/1898 | Stowell | 294/150 |
| 745,251 | A | * | 11/1903 | Sleght | 294/138 |
| 1,559,046 | A | * | 10/1925 | McLeran | 294/152 |
| 1,861,431 | A | * | 5/1932 | Crawford | 383/6 |
| 1,938,478 | A | * | 12/1933 | Bailer | 383/18 |
| 2,784,890 | A | * | 3/1957 | Chisholm | 294/152 |
| 3,301,453 | A | * | 1/1967 | Stewart | 294/152 |
| 3,315,857 | A | * | 4/1967 | Eclov | 294/152 |
| 3,865,292 | A | | 2/1975 | Foley | |
| 3,923,222 | A | * | 12/1975 | Groves | 294/157 |
| 3,933,287 | A | | 1/1976 | Foley | |
| 4,101,109 | A | * | 7/1978 | Edwards | 248/317 |
| 4,127,223 | A | | 11/1978 | Uchin | |
| 4,235,355 | A | | 11/1980 | Henry et al. | |
| 4,431,226 | A | | 2/1984 | Weilert | |
| 4,881,684 | A | * | 11/1989 | Chinman | 190/115 |
| 4,887,752 | A | | 12/1989 | Nauta | |
| 5,031,733 | A | * | 7/1991 | Chang | 190/1 |
| D340,583 | S | * | 10/1993 | Kahn | D3/202 |
| 5,251,945 | A | * | 10/1993 | Stoops | 294/152 |
| 5,285,939 | A | * | 2/1994 | Hogan | 224/250 |
| 5,361,956 | A | | 11/1994 | Recanati | |
| 5,409,282 | A | * | 4/1995 | Bale | 294/152 |
| 5,505,353 | A | * | 4/1996 | Marsh, Jr. | 224/148.6 |
| 5,579,966 | A | * | 12/1996 | Krumweide et al. | 224/637 |
| 5,823,594 | A | | 10/1998 | Hayes et al. | |
| 5,863,088 | A | * | 1/1999 | Kelly et al. | 294/146 |
| 5,887,923 | A | * | 3/1999 | Gardner, III | 294/81.55 |
| 6,347,730 | B1 | * | 2/2002 | Frederick | 224/259 |
| D460,620 | S | * | 7/2002 | Smithey | D3/315 |
| 6,547,436 | B2 | * | 4/2003 | Sutton | 383/18 |

* cited by examiner

*Primary Examiner* — J. Gregory Pickett
*Assistant Examiner* — Todd Anderson
(74) *Attorney, Agent, or Firm* — Sul Lee PLLC

(57) ABSTRACT

A device and method for carrying an object has a cradle that supports the object, one or more carrying straps attached to opposing ends of the cradle and forming a single lifting point, and one or more restraining straps attached to the carrying strap. The carrying strap may be detachably joined to form the single lifting point, and there may be a handle at the lifting point. The carrying straps and restraining straps may be adjustable in length. The device can be folded into a compact configuration for portability.

12 Claims, 6 Drawing Sheets

CARRYING DEVICE FOR PORTABLE OBJECTS

BACKGROUND OF THE INVENTION

This invention relates generally to carrying devices and specifically to a carrying device enabling a single individual to carry objects that would otherwise be too awkward or too large to be carried by a single person.

Currently, carriers for objects which are too large or awkward to be carried under a person's arm typically support the object either under the middle of the object, at the ends of the object, or in a net. If a carrier supports an object only under its middle, the object is susceptible to rocking forward or backward and falling out of the carrier. Such carriers have been adapted to minimize this danger by lining the carrier with a high friction material, such as rubber, to prevent the object sliding out of the carrier when it rocks, or by tightening the carrier around the object to clasp it more securely when it rocks. A tightened strap is also often used when carrying more than one object in the carrier, to clamp the objects to each other while restraining them in the carrier.

If a large object is carried only from its ends, the object must be stiff enough to support its own weight over its entire length. The object must also be stiff enough to resist crumpling under the compressive force created when the carrier is supported at a point near the middle of the object, thereby pulling inward on the ends of the object as well as upward. Indeed, such carriers often depend on this compressive force to keep the object securely within the carrier.

If a large object is carried in a net, it must be placed carefully in the net to ensure that the net is smoothly spread under the object, thereby supporting the object across its entire bottom and avoiding the compressive forces on the object described above for an object supported only at its ends. Additionally, a net used to carry a thin large object must be gathered at the sides to one tension, to support the object being carried, and gathered at the ends with less tension to restrain the object from forward and backward rocking without imparting compressive forces as described above for an object supported only at its ends.

Thus, current carriers for large objects, in order to prevent the objects from falling out of the carrier, often presume some internal stiffness and robustness in the object being carried, to permit it to survive being clamped around the middle or compressively supported from the ends.

BRIEF SUMMARY OF THE INVENTION

Aspects of the invention are found in a device for carrying large, awkward objects. The device has a cradle for supporting the carried object and at least one carrying strap attached to opposing ends of the cradle. The carrying strap forms a single lifting point. At least one restraining strap is attached to the carrying strap and restrains the sides of the object not restrained by the carrying strap when the carrying strap is used to carry the object.

Additionally, the carrying strap may be detachably joined to form the single lifting point and the lifting point may have a handle.

Further aspects of the invention are found in a carrying strap or a restraining strap that is adjustable in length.

Further aspects of the invention may be found in a method for carrying an object. The method contains the steps of supporting the object in a cradle, attaching at least one carrying strap to opposing ends of the cradle, extending the carrying strap up opposing sides of the object, joining the carrying strap at the top to form a single lifting point, and attaching at least one restraining strap to the carrying strap, to restrain the sides of the object not restrained by the carrying strap when the carrying strap is used to carry the object.

Other aspects of the invention can be found in a system for carrying an object, having a cradle, at least one carrying strap attached to opposing ends of the cradle and joined to form a single lifting point, and a plurality of restraining straps attached to the at least one carrying strap and acting to restrain the objects within the cradle.

Other aspects, advantages and novel features of the present invention will become apparent from the detailed description of the invention when considered in conjunction with the accompanying drawings.

BRIEF DESCRIPTION OF THE DRAWINGS

For a more complete understanding of the present invention and the advantages thereof, reference should be made to the following Detailed Description taken in connection with the accompanying drawings in which.

DETAILED DESCRIPTION OF THE INVENTION

Persons who handle large or awkwardly shaped objects are faced with a challenge when attempting to carry one or more of those objects. The challenge is particularly great for persons of short stature or, indeed, for persons of any stature attempting to carry an object whose dimensions are large compared to the person's arm length. Some examples of persons facing such a challenge are an artist carrying a portfolio, canvas or newsprint pad; a worker carrying plywood, particleboard or gypsum panels; and a person carrying a large, awkward box. The present invention is intended to allow persons to carry such objects in a non-awkward way.

The invention presents a device for carrying large objects. The invention utilizes a continuous cradle along all, or substantially all, of an object's bottom side to support the object. Attached near opposing ends of this cradle is a carrying strap that comes up from the cradle along opposing sides of the object and joins above the object to form a single lifting point for the carrier and object. The length of this carrying strap may be adjusted, to adapt the carrying device to the size and weight of the object being carried. Restraining straps are attached to the carrying strap and pass around, encompass or enclose the front and back sides of the object to restrain it within the cradle.

When a person lifts an object using the device of the present invention, the carrying strap lifts the cradle and the object from two widely spaced points on opposing ends of the cradle, providing good stability and preventing the object from pitching forward or backward. The lifting force of the carrying strap is spread out across the bottom of the object by the cradle. The cradle also supports the weight of the object across most of the object's span, preventing any sagging or deformation of the object while it is being carried. The restraining straps passing around the front and back of the object prevent it from shifting in those directions within the cradle while being carried.

Figure 1:
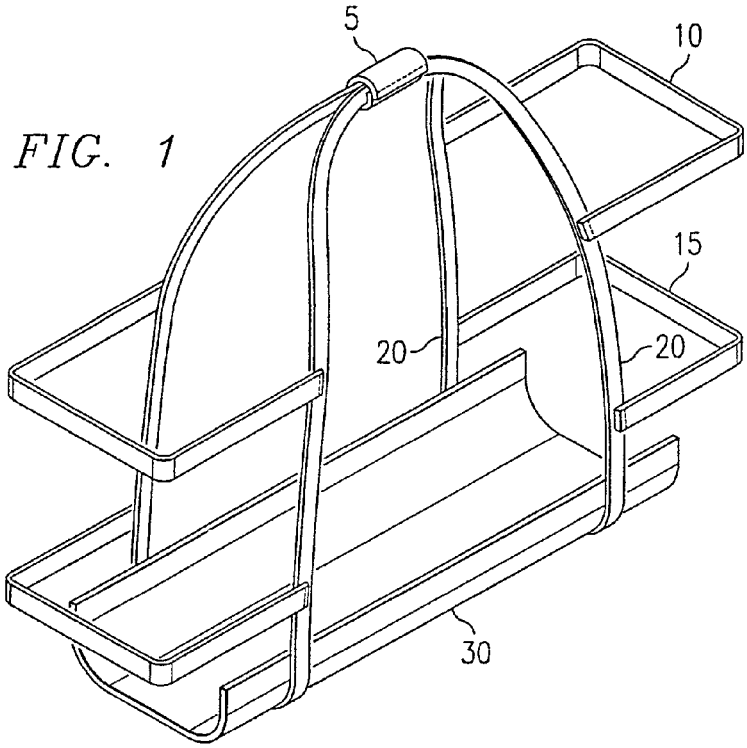
FIG. 1 presents a side view of one embodiment of the present invention.

FIG. 1 illustrates one embodiment of the present invention. In FIG. 1, cradle 30 is provided to support the object being lifted and carried. In the embodiment of the invention illustrated in FIG. 1 the cradle 30 is shown as a flexible, pliable material, but it should be understood that the present invention also encompasses embodiments employing a rigid cradle. Carrying strap 20 supports the cradle and, thus, the object being carried, during its transport. The carrying strap is gathered at handle 5 to provide a single lifting point for the person carrying the object. Restraining straps 10 and 15 are provided to restrain the object being carried from horizontal motion within the cradle 30. The restraining straps shown in the embodiment in FIG. 1 are routed horizontally around the front and back sides of the object being carried, but it should be understood that the present invention encompasses embodiments wherein the restraining straps are routed diagonally, as well.

As shown in FIG. 1, the single lifting point can be wrapped with a handle 5 for the comfort or protection of the person carrying the object. This handle could be a heavy flexible material wrapping the carrying strap. Such a strap could be held closed with a hook and loop fastener. Alternately, the handle 5 could be a hard hollow cylinder clipped around the carrying strap, for use when carrying an object by hand. In yet another embodiment of the invention, the handle 5 can be a shoulder pad used to cushion the carrying strap 20 when carrying an object over the shoulder. Handle 5 can be detachably attached to carrying strap 20 to allow easier insertion and removal of the object being carried in the carrier and to allow substitution of the different types of handle 5 described above.

Carrying strap 20 can be a single strap routed around each end of the cradle and up to the single lifting point, or it can be two or more separate straps attached to the cradle and passed through or attached to the handle. The pieces of the carrying strap can be permanently joined to form the single lifting point. Alternatively, they can be detachably joined, allowing them to be separated to place objects in the cradle for carrying.

Carrying strap 20 can be adjusted in length to allow the single lifting point to be carried in a person's hand or supported on a person's shoulder. This length adjustment can be achieved with known strap technologies, such as buckles, hook and loop fasteners, and 'double-D' rings, among others. Alternatively, if the carrying strap is made of four free ends that are detachably joined at handle 5, the length of the strap can be adjusted by passing more or less of the four strap ends through the handle before joining them to form the single lifting point. Passing more of the strap ends through the handle, leaving the free ends hanging out, will move the handle closer to restraining strap 10, thereby shortening carrying strap 20. Conversely, joining the straps at their ends, will move the handle farther from the restraining strap and lengthen the carrying strap.

Figure 2:
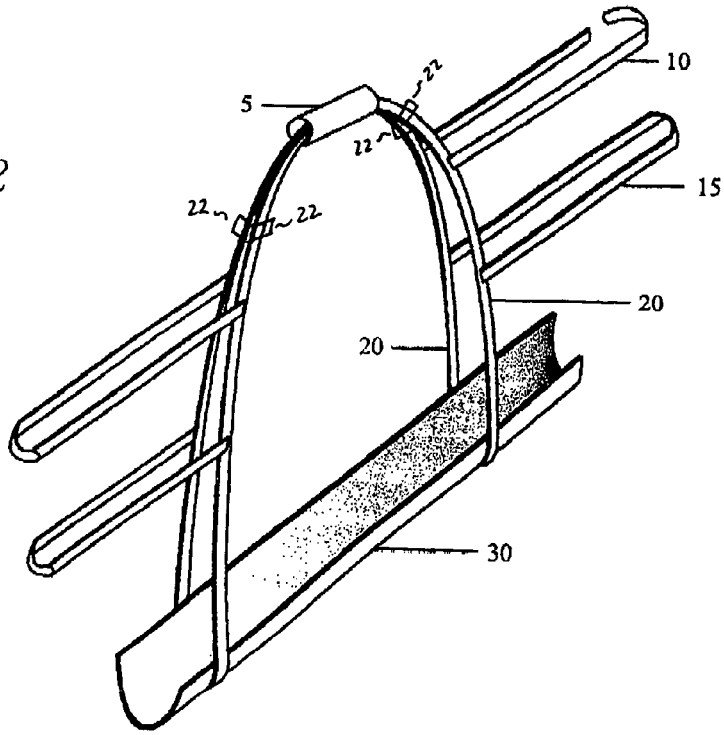
FIG. 2 presents a side view of an embodiment of the present invention, with one restraining strap unfastened.

FIG. 2 shows an embodiment of the present invention with restraining strap 10 detached, to permit easier insertion or removal of the object being carried into or from the carrier. Both restraining straps 10 and 15, and their counterparts at the other end of the cradle, can be detached and reattached and can have their length adjusted with length adjustment device 22 to adapt to the size of the object being carried. This attachment and length adjustment can be achieved with the same known strap technology mentioned above.

Figure 3:
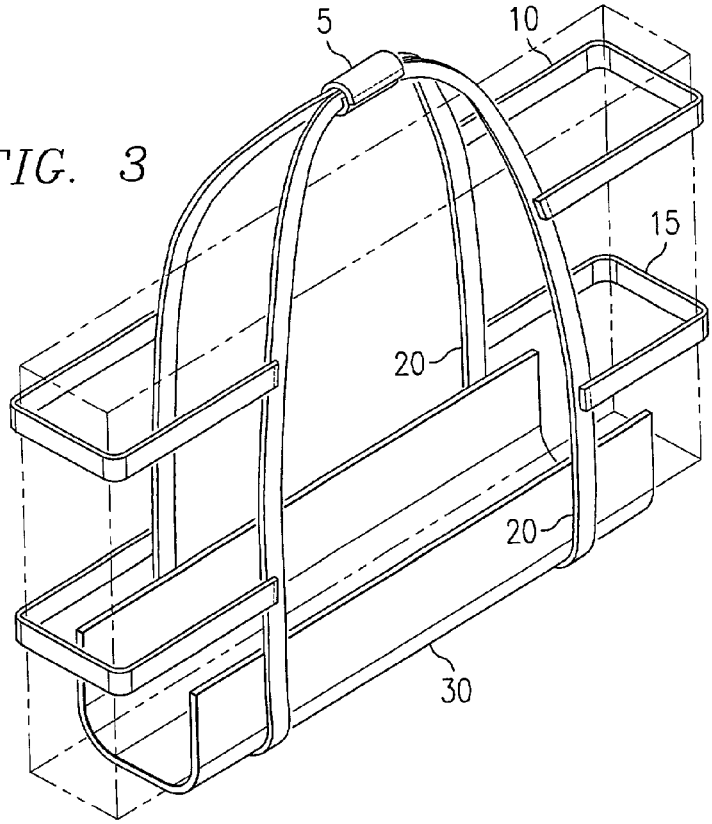
FIG. 3 illustrates one embodiment of the present invention encasing a panel-shaped object.

FIG. 3 illustrates an embodiment of the present invention encasing a narrow, panel-shaped object, such as a painting, with the restraining straps 10 and 15 adjusted to keep the object in position on the cradle. As illustrated in FIG. 3, when being carried, tension on the carrying strap 20 draws the flexible cradle up around the sides of the object being carried, thereby preventing lateral motion of the object and, if multiple objects are being carried at the same time, securing the objects together laterally to prevent their banging into each other while being carried.

Figure 4:
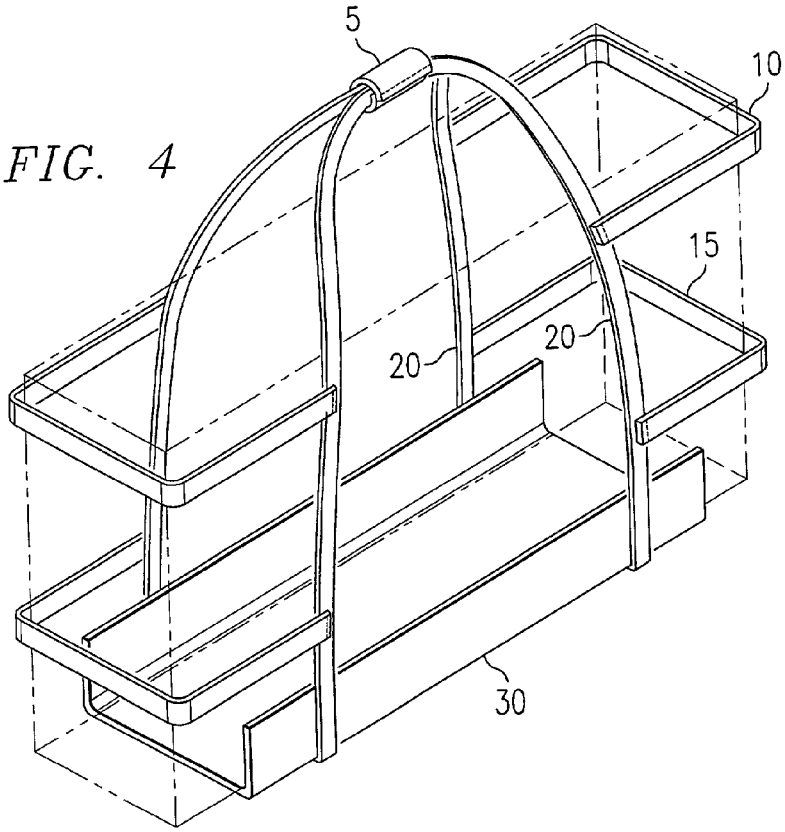
FIG. 4 illustrates an embodiment of the present invention encasing a box-shaped object.

FIG. 4 illustrates another embodiment of the present invention with its restraining straps 10 and 15 adjusted to encase a larger, box-shaped object. In this embodiment, cradle 30 is made from a rigid material, such as metal or a hard plastic.

Figure 5:
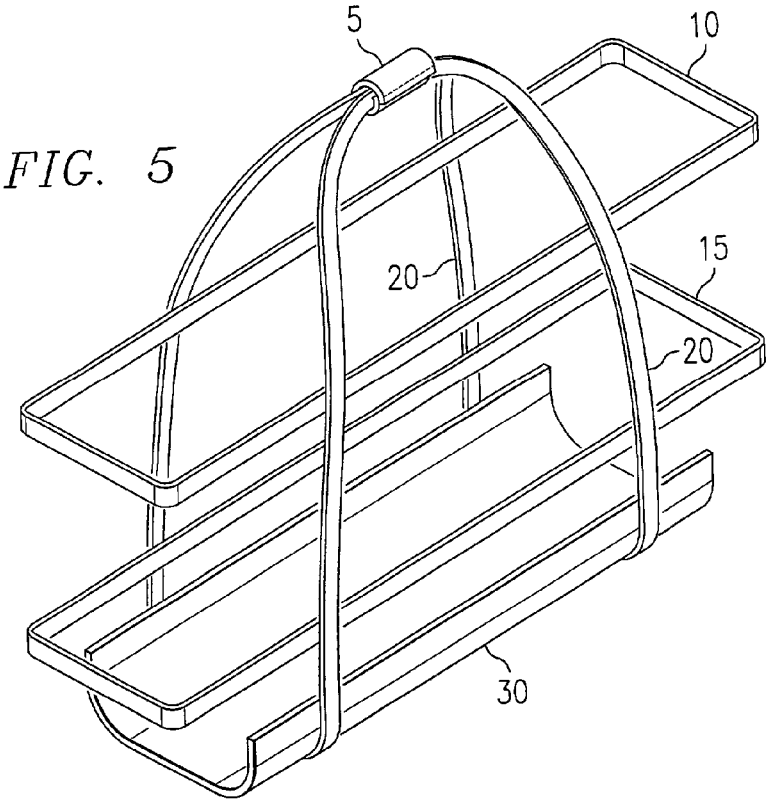
FIG. 5 presents a view of an alternative embodiment of the present invention with continuous restraining straps.

FIG. 5 depicts an alternative embodiment of the invention, wherein the restraining straps 10 and 15 are continuous along the length of the carrier. Forces exerted upon the restraining straps when they are acting to restrain the object being carried will, in this embodiment, be distributed along the length of the restraining straps, rather than being transferred solely to the nearest carrying strap 20. In the situation where an object being carried pitches forward or backward to the point where its weight is being supported in part by the restraining straps 10 and 15, the embodiment shown in FIG. 5 will transfer that weight to all four legs of carrying strap 20. In the embodiment of the present invention shown in FIG. 1, when the object being carried pitches forward or backward, part of its weight will be supported by the restraining straps 10 and 15 at only one end of the object, and those restraining straps will transfer that weight to only two legs of carrying strap 20.

While the restraining straps are shown on the inside of carrying strap 20 in FIG. 5, it should be understood that in another embodiment of the invention they could be attached to the outside of carrying strap 20. Alternatively, the restraining straps could pass through slots in carrying strap 20, allowing the carrying strap to slide along the restraining straps to accommodate objects of different shapes and weights. In yet another embodiment, the carrying strap 20, the restraining straps 10 and 15 and the cradle 30 could be molded or otherwise fabricated from a single piece of material.

Figure 6:
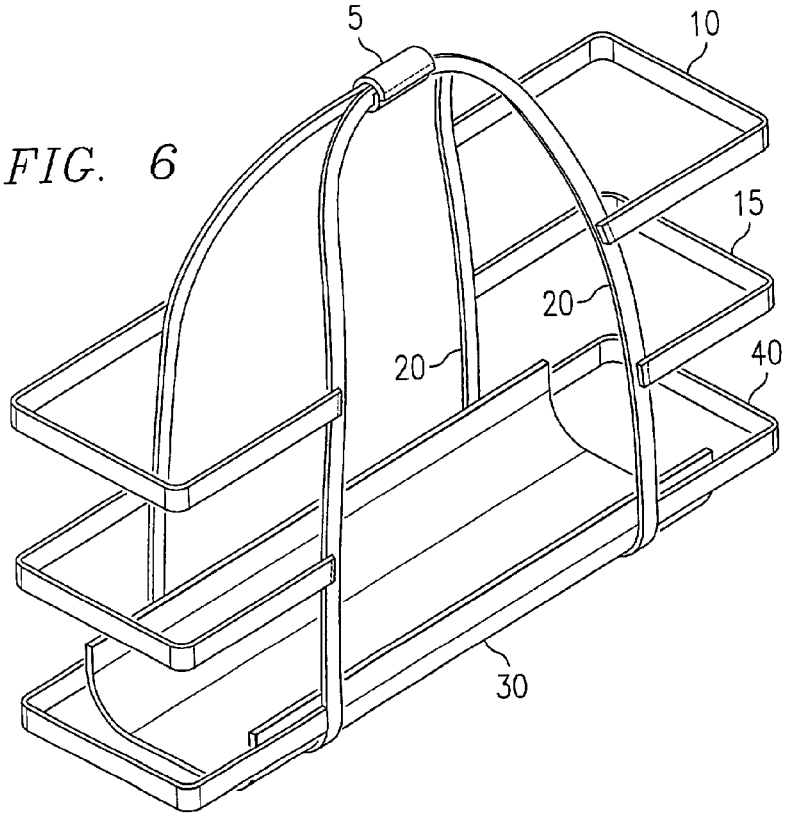
FIG. 6 shows another alternative embodiment of the present invention with restraining straps at the ends of the supporting cradle.
Figure 7:
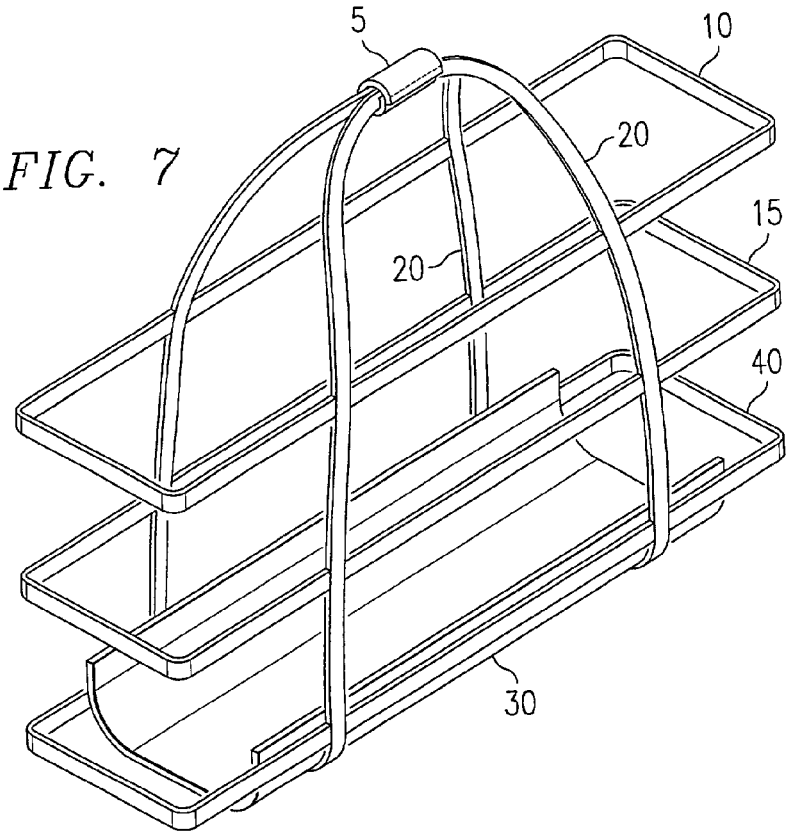
FIG. 7 shows an alternative embodiment of the present invention with continuous restraining straps.

FIG. 6 illustrates another embodiment of the invention, wherein a restraining strap 40 is placed near the ends of the cradle, to provide further assurance that the object being carried will remain in the cradle while being carried. Restraining strap 40 can also be detached and adjusted in length, as described above for restraining straps 10 and 15 in the embodiment shown in FIG. 2. FIG. 7 shows a similar embodiment, wherein the restraining straps 10, 15 and 40 are continuous along the length of the cradle, providing the same benefits as described above for restraining straps 10 and 15 in the embodiment shown in FIG. 5.

Figure 8:
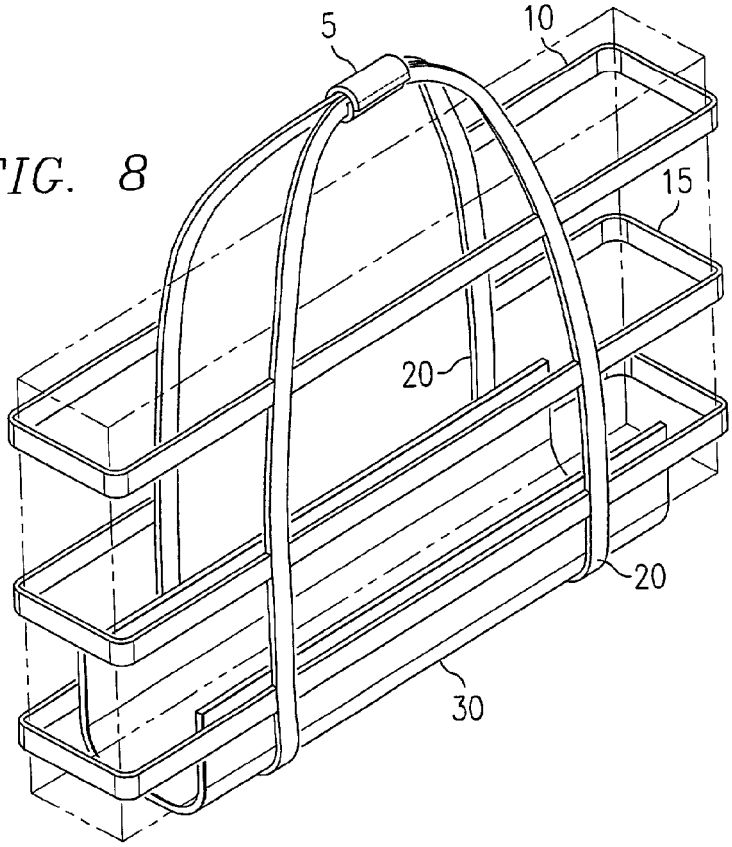
FIG. 8 illustrates an alternative embodiment of the present invention encasing a panel-shaped object.
Figure 9:
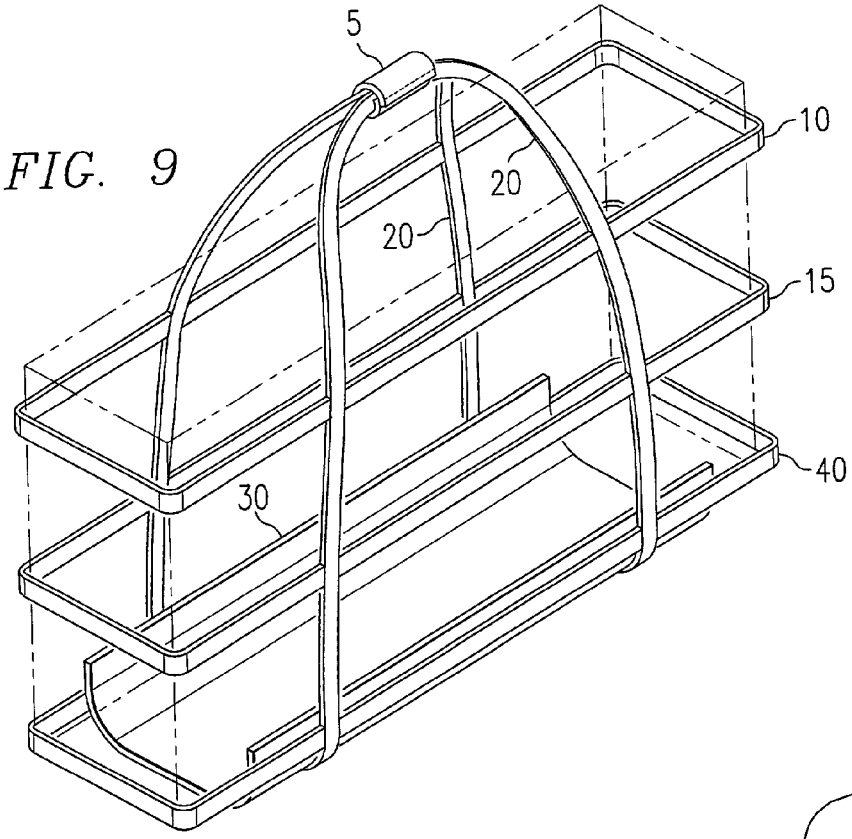
FIG. 9 illustrates an alternative embodiment of the present invention encasing a box-shaped object.

FIG. 8 illustrates the embodiment of the invention from FIG. 7 encasing a flat, panel-shaped object. FIG. 9 illustrates the same embodiment encasing a thicker, box-shaped object, the restraining straps 10, 15 and 40 having been detached to allow insertion of the object and then having been re-attached and adjusted in length to securely restrain the object in the cradle. The embodiment shown in FIG. 9 makes use of a cradle 30 made of a flexible material.

Figure 10:
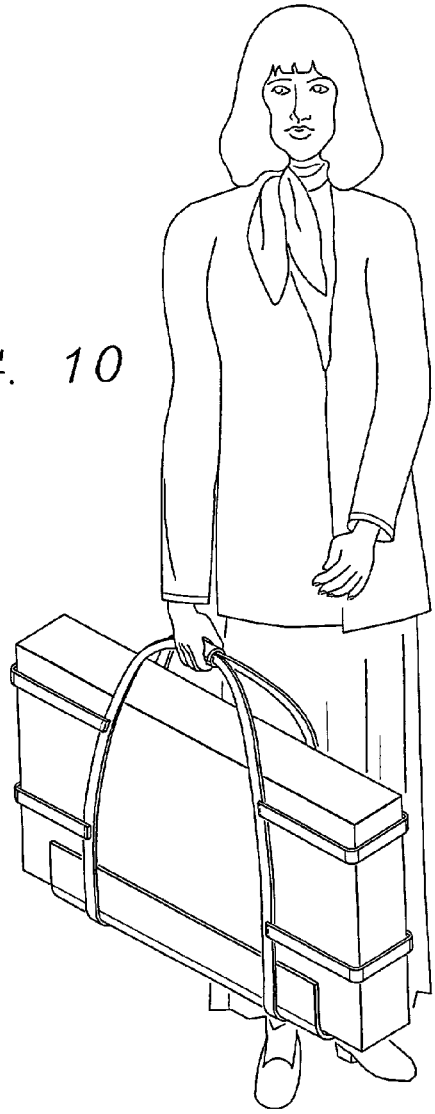
FIG. 10 shows a person utilizing one embodiment of the present invention to carry an object by hand.

FIG. 10 depicts a person carrying a large object by hand using an embodiment of the present invention. As can be seen, the object, which is too large to be carried with one hand and inconvenient to carry in two hands, can be carried easily by one hand using a carrier made according to the present invention.

Figure 11:
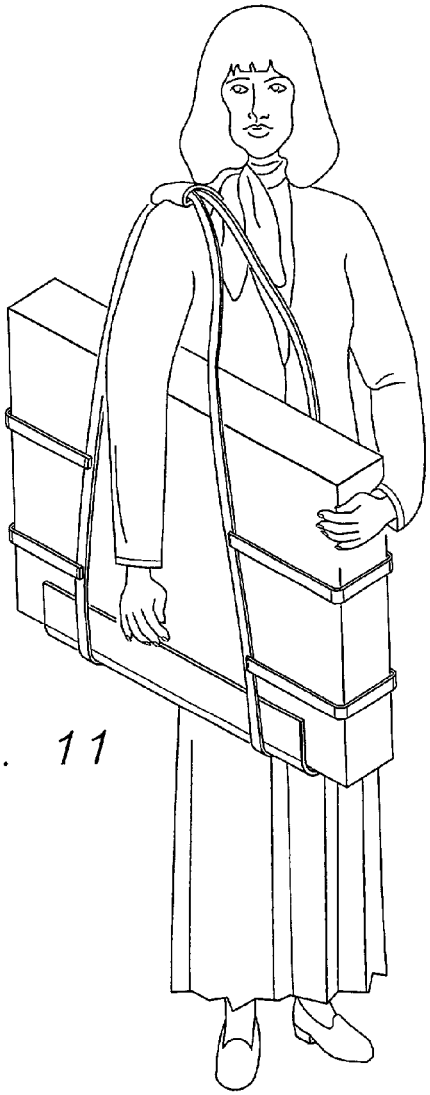
FIG. 11 shows a person utilizing an embodiment of the present invention to carry an object over the shoulder.

In FIG. 11, a person is depicted carrying an embodiment of the present invention over her shoulder, having adjusted the length of the carrying straps and having attached a shoulder pad to the single lifting point to cushion her shoulder.

Figure 12:
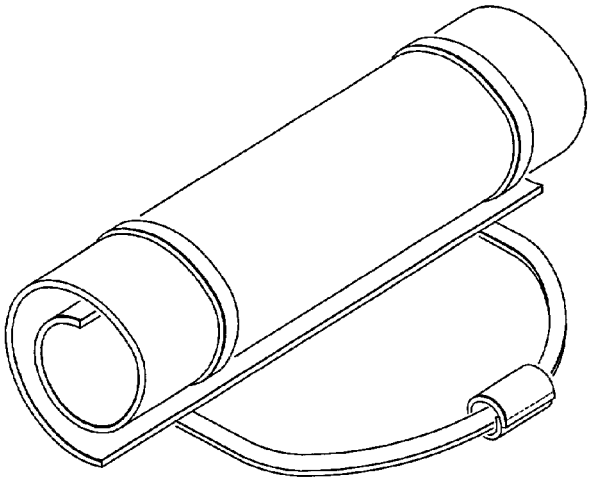
FIG. 12 illustrates an empty embodiment of the present invention rolled up for carrying.
Figure 13:
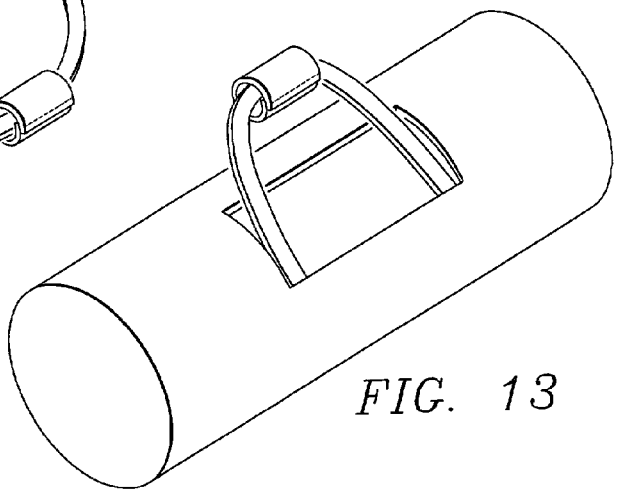
FIG. 13 shows an empty embodiment of the present invention rolled up and stowed in a carrying case.

FIG. 12 shows an embodiment of the present invention emptied and folded into a compact shape for portability. The restraining straps and a portion of the carrying strap are tucked inside the cradle, which is then rolled up to create a parcel for storage or transportation. FIG. 13 shows the embodiment of the present invention similarly folded and packed in a carrying case.

As such, an apparatus and method for carrying large, awkward objects is described. In view of the above detailed description of the present invention and associated drawings, other modifications and variations will now become apparent to those skilled in the art. It should also be apparent that such other modifications and variations may be effected without departing from the spirit and scope of the present invention as set forth in the claims which follow.

What is claimed is:

1. A device for carrying a portable object, comprising:

a cradle having open longitudinal ends and operable to support an object, the cradle being substantially continuous in a longitudinal direction of the device;

as carrying strap attached to the cradle, the carrying strap having a loop shape and folded such that corresponding opposing ends of an axis of the loop shaped carrying strap are adjacent to form a single lifting point; and a plurality of restraining strap, each restraining strap coupled to the carrying strap, the restraining strap configured to restrain horizontal movement of the object when the object is located within the cradle, wherein lateral sides of the cradle extend upwardly along a portion of the carrying strap above a first one of said restraining straps and terminate below a second one of said restraining straps, wherein the carrying strap supports the cradle such that a respective portion of the carrying strap is routed around the bottom of the cradle substantially at each said longitudinal end of the cradle.

2. The device of claim 1, wherein the cradle comprises a rigid cradle.

3. The device of claim 1, wherein the carrying strap is configured having an adjustable length.

4. A device for carrying a portable object, comprising:

a cradle having open longitudinal ends and operable to support an object, the cradle being substantially continuous in the longitudinal direction of the device;

a carrying strap attached to opposing ends of the cradle, the carrying strap having a loop shape and folded such that corresponding opposing ends of an axis of the loop shaped carrying straps are adjacent to form a single lifting point; and a plurality of restraining snaps, each restraining strap having opposite ends thereof terminating at and attached to the carrying strap, the restraining strap configured to restrain horizontal movement of the object independently of the cradle when the object is located within the cradle, wherein lateral sides of the cradle extend upwardly along a portion of the carrying strap above a first one of said restraining straps and terminate below a second one of said restraining straps, wherein the carrying strap supports the cradle such that a respective portion of the carrying strap is routed around the bottom of the cradle substantially at each said longitudinal end of the cradle.

5. The device of claim 4, wherein at least one of the plurality of restraining straps is configured having an adjustable length.

6. The device of claim 4, wherein the carrying strap is configured having an adjustable length.

7. The device of claim 4, wherein the cradle comprises a rigid cradle.

8. The device of claim 4, wherein:

the cradle comprises a flexible cradle;

wherein the carrying strap extends laterally relative to the opposing ends of the cradle; and wherein the restraining straps are configured to restrain horizontal movement of the object independently of the cradle in a longitudinal direction relative to the cradle when the object is located within the cradle.

9. A device for carrying a portable object, comprising:

a flexible cradle having open longitudinal ends and operable to support an object, the cradle being substantially continuous in the longitudinal direction of the device;

a carrying strap attached to opposing ends of the cradle, the carrying strap having a loop shape and folded such that corresponding opposing ends of an axis of the loop shaped carrying strap are adjacent to form a single lifting point, and wherein sides of the cradle extend upwardly along in least a portion of the carrying strap; and a plurality of restraining straps, each restraining strap coupled to the carrying strap, the restraining strap configured to restrain longitudinal movement of the object when the object is located within the cradle, wherein lateral sides of the cradle extend upwardly along a portion of the carrying strap above a first one of said restraining straps and terminate below a second one of said restraining straps, wherein the carrying strap supports the cradle such that a respective portion of the carrying strap is routed around the bottom of the cradle substantially at each said longitudinal end of the cradle.

10. The device of claim 9, wherein the carrying strap is configured having an adjustable length.

11. The device of claim 9, wherein at least one of the plurality of restraining straps is configured having an adjustable length.

12. The device of claim 9, wherein at least one of the plurality of restraining straps comprises a detachable restraining strap enabling horizontal insertion of the object into the cradle.

* * * * *